US005932087A

United States Patent [19]

Terrase

[11] Patent Number: 5,932,087

[45] Date of Patent: Aug. 3, 1999

[54] SUBMERSIBLE ANODE AND METHOD

[75] Inventor: Leon J. Terrase, Gretna, La.

[73] Assignee: Corrpro Companies, Inc., Medina, Ohio

[21] Appl. No.: 09/001,096

[22] Filed: Dec. 30, 1997

Related U.S. Application Data

[60] Provisional application No. 60/034,911, Jan. 7, 1997.

[51] Int. Cl.[6] ..... C23F 13/00

[52] U.S. Cl. ..... 205/730; 205/732; 205/733; 205/740; 204/196.17; 204/196.23; 204/196.24; 204/196.3; 204/286; 204/297 R

[58] Field of Search ..... 204/196, 197, 204/196.17, 196.23, 196.24, 196.3, 286, 297 R; 205/730, 732, 733, 740

[56] References Cited

U.S. PATENT DOCUMENTS 4,176,033 11/1979 Council ..... 204/197
4,705,331 11/1987 Britton ..... 204/197
5,334,299 8/1994 Roden ..... 204/279

*Primary Examiner*—Bruce F. Bell
*Attorney, Agent, or Firm*—Renner, Otto, Boisselle & Sklar, P.L.L.

[57] ABSTRACT

An anode and bracket assembly for attaching sacrificial anodes to submerged structures utilizes one or more shepard's hook hanger brackets. The anode or anodes are cast directly on the bracket with a relatively deep spiral grooved profile for vortex shedding in high currents reducing vibration of the anode, bracket and structure. The hooks extend vertically and have a crook or notch designed to mate with a horizontal structural member which may be circular or rectangular. The hook has a long approach or tip and a lifting eye on top to assist in the quick placement of the bracket on the structure. A pointed contact bolt is mounted in the hook to be driven into the underside of the structure. This clamps the bracket to the structure and also provides good electrical contact between the structure and anode. The anode may extend horizontally spanning between two or more hooks or simply hang vertically from a single hook.

16 Claims, 1 Drawing Sheet

SUBMERSIBLE ANODE AND METHOD

This application claims the benefit of and is a continuation of U.S. Provisional Application No. 60/034,911, filed Jan. 7, 1997.

DISCLOSURE

This invention relates generally to a submersible anode and method, and more particularly to an anode incorporating a bracket which can readily be attached to and removed from underwater structures.

BACKGROUND OF THE INVENTION

Galvanic or sacrificial anodes are widely used for cathodic corrosion protection of underwater structures. Such sacrificial anodes create the galvanic current which protects the submerged structure, and are designed to corrode sacrificially. They accordingly must be properly electrically connected to the structure and replaced at the end of their design life. Submerged structures such as pipelines, offshore platforms, piers, pilings, or marine risers, can be very deep, and such anodes are normally installed by divers, submersibles or remotely operated vehicles. Divers, submersibles, such as manned submarines, or sophisticated remotely controlled robotic submersibles are extremely expensive to operate, and this is particularly true as the depth increases. The latter systems use robotic arms and even a diver has less than normal dexterity, particularly in a diving suit at significant depth. Such restraints also make many tools or power tools difficult to use.

In addition to the constraints of the suit, submersible, or vehicle, environmental factors such as currents, visibility, bottom condition or bottom changes, bottom time, and many other factors, all make the placement and replacement of anodes difficult.

Strong currents have been known to tear away or dislodge carefully placed anodes. They have also been known to cause or at least transfer unwanted vibration to the structure being protected. The current is believed to cause a vortex on the downstream side of the anode or bracket supporting the anode or the structure. This is believed to cause the vibration and flutter which can lead to damage.

Many such submerged structures are cylindrical or tubular in shape. This is particularly true of deep water platforms. Anodes are often positioned to be generally parallel to but spaced from a tubular structure, both horizontally and vertically. The anodes also need to make good electrical contact with the structure.

It would therefore be desirable to have an anode and bracket assembly which could quickly be hung or fastened on and removed from underwater cylindrical structures, either circular or rectangular-in-section. It would also be desirable if the assembly could easily firmly be clamped to the structure and at the same time making good electrical contact with the structure. It would also be desirable to have an anode which is configured for vortex shedding in high currents thus reducing the forces and vibration on both the anode, its bracket assembly, and the structure.

SUMMARY OF THE INVENTION

An anode and bracket assembly for attaching sacrificial anodes to submerged structures utilizes one or more shepard's hook hanger brackets. The anode or anodes are cast directly on the bracket with a relatively deep spiral grooved profile for vortex shedding in high currents reducing vibration of the anode, bracket and structure. The hooks extend vertically and have a crook or notch designed to mate with a horizontal structural member which may be circular or rectangular. The hook has a long approach or tip and a lifting eye on top to assist in the quick placement of the bracket on the structure. A pointed contact bolt is mounted in the hook to be driven into the underside of the structure by turning a Tee handle. This clamps the bracket to the structure and also provides good electrical contact between the structure and anode. The anode may extend horizontally spanning between two or more hooks or simply hang vertically from a single hook.

To the accomplishment of the foregoing and related ends, the invention then comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
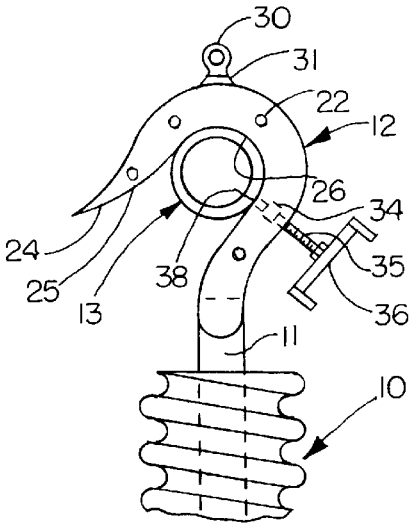
FIG. 1 is a fragmentary elevation of an anode bracket assembly in accordance with the present invention attached to a structure which is circular in section.
Figure 2:
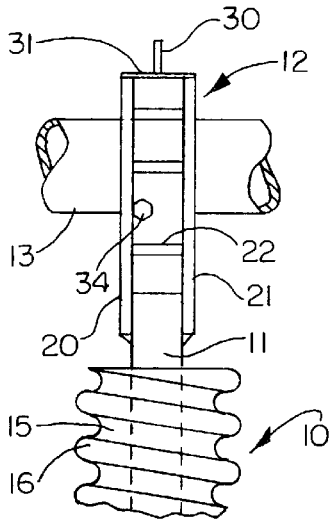
FIG. 2 is a view seen from the right hand side of FIG. 1.
Figure 6:
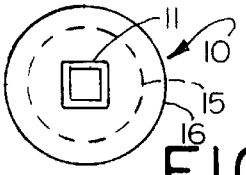
FIG. 6 is a transverse section through one form of anode.

Referring initially to FIGS. 1 and 2 there is illustrated generally an anode 10 which may be cast on a core 11, the upper end of which is secured to a shepard's hook shown generally at 12. The shepard's hook extends around and supports the anode 10 on a tubular structural member 13. As illustrated in FIG. 6, the core 11 may be a rectangular tubular member around which the anode 10 is cast.

The anode is cast with a spiral groove indicated at 15. The groove forms a spiral ridge 16 which is approximately the same width as the groove. The depth of the groove is approximately half of the radial extent of the anode. The sacrificial anode may be an aluminum, magnesium or other anodic alloy, for example.

The shepard's hook is formed with two plates seen at 20 and 21 which may be welded to the top of the core 11. The plates may be laterally interconnected by rods 22 to form a unitary structure. The tip of the hook indicated at 24 has a long approach 25 which extends into the crook or notch 26 of the hook. The configuration of the notch is designed generally to conform to the exterior of the structure.

The top of the shepard's hook is provided with a lifting eye 30 extending from a bridge plate 31 spanning the two side plates 20 and 21. The lifting eye facilitates the hoisting or lifting of the anode and bracket either with a hoist, or flotation devices, for example. With the configuration of the hook illustrated in FIG. 1, the anode and bracket assembly can easily be positioned on the structure 13.

The interior of the plate 20 is provided with a coupling nut indicated at 34. The coupling nut may be welded to the interior of the plate and is internally threaded. The coupling nut receives a pointed threaded bolt 35 which includes a Tee drive head 36. The drive head is configured to interfit with submersible manipulators and tools commonly used underwater. The pointed tip of the bolt engages the structure on the underside thereof as indicated at 38. When tightened, the bolt clamps the bracket to the structure and also provides good electrical contact between the anode and structure.

Figure 3:
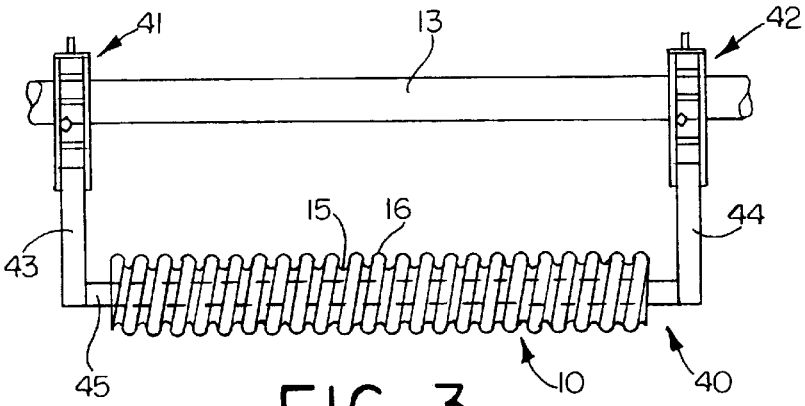
FIG. 3 is a view of an anode spanning two hooks.

Referring now to FIG. 3 it will be seen that the anode bracket assembly shown generally at 40 includes two hooks 41 and 42 which are secured to equal length hangers 43 and 44, respectively, which support the core 45 suspended therebetween. The core thus spans the two hangers and the hooks. The anode shown generally at 10 is cast upon the core 45. The anode 10 is thereby supported parallel to and spaced from the structure 13. It will be appreciated that more than two hooks may be employed and that a string of similar anodes may be supported along the structure 13 in similar fashion.

Figure 4:
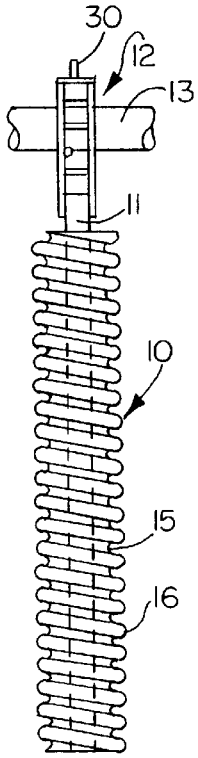
FIG. 4 is a view of an anode extending vertically from one hook.

As seen in FIG. 4, the anode 10 may extend primarily vertically. The anode may be positioned spaced from but generally parallel to a vertical riser not shown.

The spiral groove of the anode having the configuration shown has been found to minimize vibrations in the anode bracket assembly and the structure itself due to high currents. The spiral grooves are believed to assist in the shedding of the vortex which forms on the downstream side of the anode.

Figure 5:
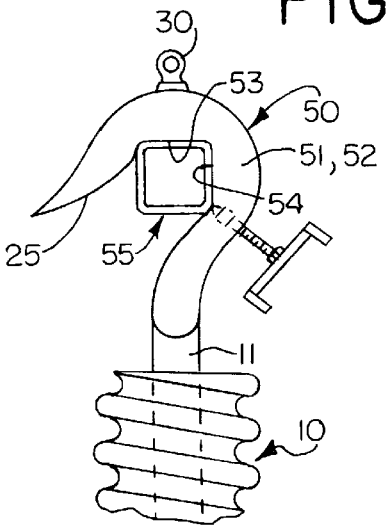
FIG. 5 is a view like FIG. 1 showing a somewhat modified anode bracket supported from a structure rectangular-in-section.

Referring now to FIG. 5 there is illustrated an anode 10 cast on core 11 supported by hook 50 formed of side plates 51 and 52. The only difference between the hook 50 and the hook 12 is that the interior notch is formed with relatively flat surfaces seen at 53 and 54 to accommodate a rectangular tubular structure 55. The hook includes the lifting eye 30 and the long approach 25 which enables the hook of the anode bracket assembly easily to be lowered over the structure 55. Once lowered over the structure, the pointed bolt 35 is driven into the undersurface at the corner illustrated locking the bracket assembly to the structure and providing good electrical contact between the anode and the structure.

Figure 7:
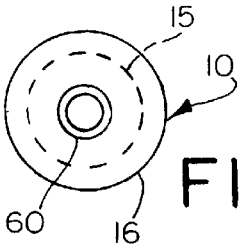
FIG. 7 is a similar section through another form.

In comparing FIGS. 6 and 7 it will be seen that the core 11 in FIG. 6 is rectangular in configuration or a square tube. The core 60 in FIG. 7 is, however, circular, but the anode is the same with the spiral grooves and adjoining ridges which facilitate the shedding of the vortex and the reduction of unwanted vibrations caused by underwater currents.

It can now be seen that there is provided an anode and bracket assembly for attaching sacrificial anodes to submerged structures utilizing one or more shepard's hook hanger brackets. The anode or anodes are cast directly on the bracket with the relatively deep spiral groove profile for vortex shedding in high currents reducing vibrations of the anode, bracket and structure. The configuration of the hook enables the bracket assembly quickly and easily to be attached and removed from the structure and the pointed bolt not only clamps the bracket assembly to the structure but also provides good electrical contact between the structure and the anode.

To the accomplishment of the foregoing and related ends, the invention then comprises the features particularly pointed out in the claims, these being indicative, however, of but a few of the various ways in which the principles of the invention may be employed.

I claim:

1. An anode and bracket assembly for underwater structures comprising a bracket adapted to be secured to such underwater structures, and a groove in said anode for vortex shedding caused by underwater currents to reduce vibration on said anode bracket and structure.

2. An anode and bracket assembly as set forth in claim 1 wherein said anode is circular in section and is cast upon the bracket, and said groove has a depth about half the radial thickness of the anode.

3. An anode and bracket as set forth in claim 1 wherein said groove is spiral and forms a spiral ridge on the surface of the anode, and said ridge and groove are substantially the same width.

4. An anode and bracket assembly as set forth in claim 3 wherein said bracket includes a shepard's hook supporting said anode.

5. An anode and bracket assembly as set forth in claim 4 wherein said hook has a crook conforming to the exterior of the structure, and a contact bolt adapted to be driven into said structure and providing good electrical contact between said structure and anode.

6. An anode and bracket assembly as set forth in claim 5 wherein said contact bolt is pointed and aimed at the underside of the structure.

7. An anode and supporting bracket assembly for underwater structures, said bracket assembly including a shepard's hook having a crook fitting the structure, and a contact clamp bolt adapted to be driven into the structure to clamp the bracket to the structure and to provide good electrical contact between the anode and structure.

8. An assembly as set forth in claim 7 wherein said hook has a long approach end and a lifting attachment on top to facilitate placement.

9. An assembly as set forth in claim 8 wherein said contact clamp bolt is pointed and aimed at the underside of the structure.

10. An assembly as set forth in claim 9 including a Tee handle for driving said bolt.

11. An assembly as set forth in claim 10 wherein said anode is provided with a spiral groove for vortex shedding.

12. A method of cathodically protecting underwater structures comprising the steps of forming an elongated anode with transverse vortex shedding grooves on a bracket, and securing said bracket and thus said anode to a structure to be protected underwater with good electrical contact between the structure and anode, with the vortex shedding grooves minimizing vibrations caused by underwater currents.

13. A method as set forth in claim 12 including the step of forming the grooves spirally.

14. A method as set forth in claim 13 including the step of forming the grooves to be the same width as the adjoining ridges, and having substantial depth.

15. A method as set forth in claim 14 including the step forming the bracket with a shepard's hook and supporting said anode and bracket on said structure with said shepard's hook.

16. A method as set forth in claim 15 including the step of locking the shepard's hook to said structure while concurrently ensuring good electrical contact between the structure and anode.

* * * * *